US006312177B1

(12) United States Patent
Nureki

(10) Patent No.: US 6,312,177 B1
(45) Date of Patent: Nov. 6, 2001

(54) LINE PRINTER

(75) Inventor: Shinji Nureki, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/456,618

(22) Filed: Dec. 8, 1999

(30) Foreign Application Priority Data

Dec. 21, 1998 (JP) ..... 10-363229

(51) Int. Cl.[7] ..... B41J 13/00
(52) U.S. Cl. ..... 400/578; 347/104
(58) Field of Search ..... 400/578, 579, 400/615.2, 120.04, 240.3, 249, 639.1, 708, 185; 347/104

(56) References Cited

U.S. PATENT DOCUMENTS 4,586,834 * 5/1986 Hachisuga et al. ..... 400/240.03
4,707,159 * 11/1987 Hirano et al. ..... 400/639.1
5,226,741 * 7/1993 Kumazaki et al. ..... 400/579
5,344,244 * 9/1994 Fukahori et al. ..... 400/249
5,502,477 * 3/1996 Osada et al. ..... 400/120.04
5,807,000 * 9/1998 Kawamura et al. ..... 400/237
6,132,120 * 10/2000 Yamaguchi et al. ..... 400/615.2

* cited by examiner

*Primary Examiner*—Eugene Eickholt
(74) *Attorney, Agent, or Firm*—Adams & Wilks

(57) ABSTRACT

A line printer is provided in which disturbances during the start of printing are prevented with low power consumption. The printer has a motor control section which performs a stop printing operation by driving a stepping motor in a direction reverse to that in which print paper is fed by a predetermined number of steps and then turns off the stepping motor to stop printing and performs a start printing operation in which the stepping motor is driven in a forward direction by the same predetermined number of steps before starting a printing operation.

20 Claims, 5 Drawing Sheets

LINE PRINTER

BACKGROUND OF THE INVENTION

1. Field of the Invention

The present invention relates to a line printer for simultaneously printing characters etc, while feeding print paper in units of lines.

2. Description of the Related Art

Heretofore, a line printer for simultaneously printing characters etc. according to a print signal input from a host, feeding print paper in units of line has been used.

FIG. 4 is a side view showing the outline of a print paper feeding mechanism in a general line printer.

As shown in FIG. 4, when a stepping motor 401 is rotated counterclockwise by a predetermined amount as shown by an arrow, the above-mentioned rotation is transmitted to a platen roller 404 via two gears 402 and 403. As a result, the platen roller 404 is rotated clockwise and feeds print paper 405 in units of lines. In a synchronous matter therewith, the printer prints characters etc. in response to a print signal from a host (not shown) by driving a print head 406, while feeding the print paper 405 in units of lines.

FIG. 5 is a timing chart showing a conventional driver signal in the case that the stepping motor 401 is driven. When printing according to a print signal is executed in an area A and is completed, a driver signal to the stepping motor 40i is stopped in an area D and the stepping motor 401 is stopped. In the next operation, first, a driver signal of the same phase as a supplied phase when the stepping motor 401 is stopped, is supplied, to align the position (area E). Thereafter, the printing operation is started (area G) by supplying a driver signal of the next phase.

When a driver signal sent to the stepping motor 401 is stopped and the stepping motor is in a state in which it is not excited, a counterclockwise force is applied to the shaft of the platen roller 404 by the spring force of the platen roller 404, because the print head 406 is fixed. As a result, a clockwise torque is applied to the stepping motor 401 via the gears 403 and 402. When the above-mentioned torque exceeds inhibiting torque that the stepping motor 401 per se has, the stepping motor 401 is rotated clockwise.

Therefore, when the stepping motor 401 is next driven, a phase output from a motor control circuit and the actual phase of the stepping motor 401 are asynchronous. Therefore, when a driver signal of the same phase as a phase when the stepping motor 401 is stopped, is supplied to the stepping motor 401 (area E of FIG. 5) so as to drive the motor next, if the stepping motor 401 is reversed by more than two steps, the motor is reversed to the same phase before four steps or steps of a multiple of four from a position where the stepping motor 401 is stopped, and printing is started from the above-mentioned position (area G of FIG. 5). Accordingly, there arises a problem in that printing for the four steps or the steps of the multiple of four is packed at the head.

To prevent the above-mentioned situation, a method of supplying holding current of low voltage to the stepping motor 401 while the stepping motor 401 is stopped is also conceivable. However, consumed current is increased and it is particularly a large problem in a line printer driven by a cell.

SUMMARY OF THE INVENTION

The present invention has been made to solve the above-mentioned problems, and therefore an object of the invention is to provide a line printer in which large power consumption is not required and turbulence when printing is started, can be inhibited.

According to the present invention, there is provided a line printer for rotating a platen roller by forwardly rotating a motor by motor control means to feed a print paper by a fixed amount, and synchronously therewith, for effecting printing by driving a print head in accordance with a print signal, characterized in that:

the motor control means turns off the motor after reversing the motor by a predetermined amount when the motor is turned off to stop printing; and the motor control means starts printing operation after forwardly rotating the motor by the same predetermined amount to start printing. The motor control means turns off the motor after reversing the motor by the predetermined amount when the motor is turned off to stop printing, and starts a printing operation after forwardly rotating the motor by the above-mentioned predetermined amount to start printing.

The above-mentioned motor control means may be configured so that the motor control means turns off the motor after reversing the motor by a predetermined amount in case that a printing condition is not met within-a predetermined time after the printing of one line is completed.

Also, the above-mentioned motor may be composed of a stepping motor, and configured so that the motor control means turns off the stepping motor after reversing the stepping motor by a predetermined number of steps when the stepping motor is turned off to stop printing; and the motor control means starts printing operation after forwardly rotating the stepping motor by the predetermined number of steps to start printing.

Further, the above-mentioned motor control means may be configured so that the motor control means forwardly rotates the stepping motor by the predetermined number of steps after outputting the same phase as a phase output immediately before turning off the stepping motor, to the stepping motor when the stepping motor is driven to start printing, and then starts the printing operation.

DESCRIPTION OF THE PREFERRED EMBODIMENTS

Figure 1:
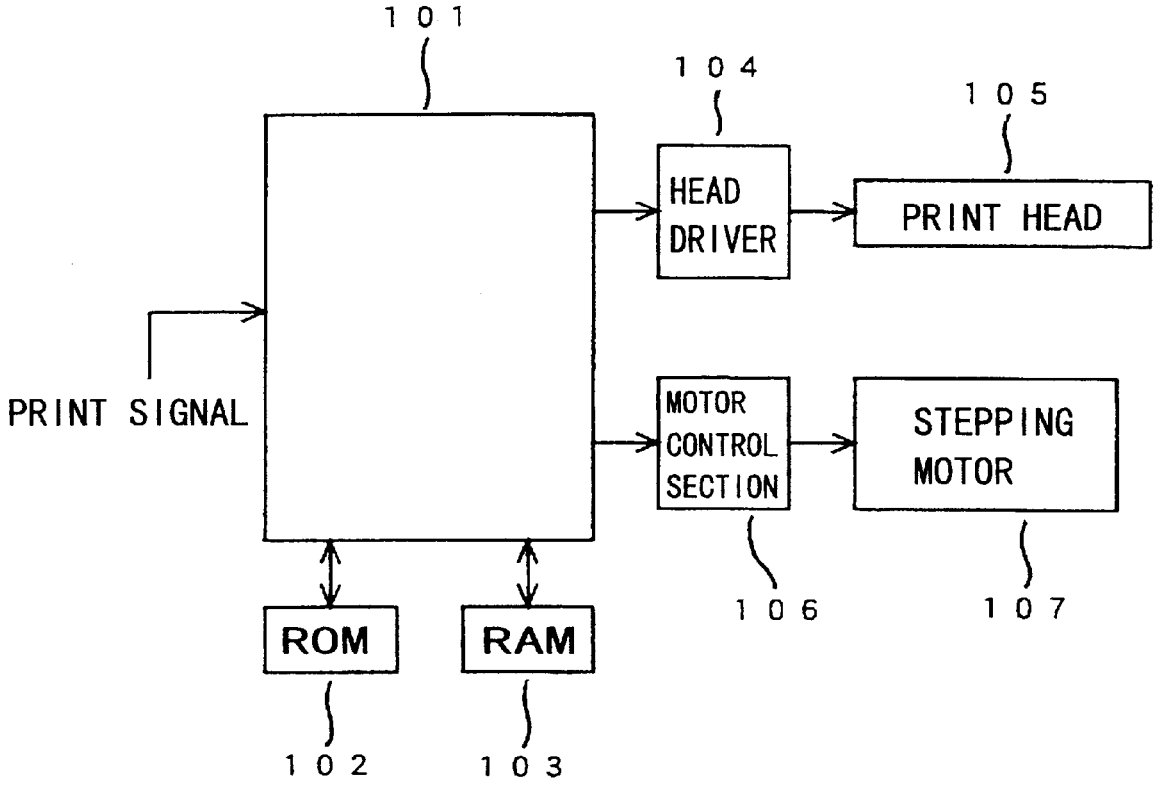
FIG. 1 is a block diagram showing a line printer according to to an embodiment of the present invention.

FIG. 1 is a block diagram showing a line printer according to an embodiment of the present invention. As shown in FIG. 1, a read only memory (ROM) 102, a random access memory (RAM) 103, a head driver 104, and a motor control section 106 are connected to a central processing unit (CPU) 101 to which a print signal such as print data is input and which constitutes motor control means. The read only memory (ROM) 102 stores a processing program for execution by the CPU. A random access memory (RAM) 103 is used to store print data, etc. A head driver 104 serves for driving a print head 105. A motor control section 106 controls the rotation of a stepping motor 107 and constitutes together with the CPU motor control means.

Figure 2:
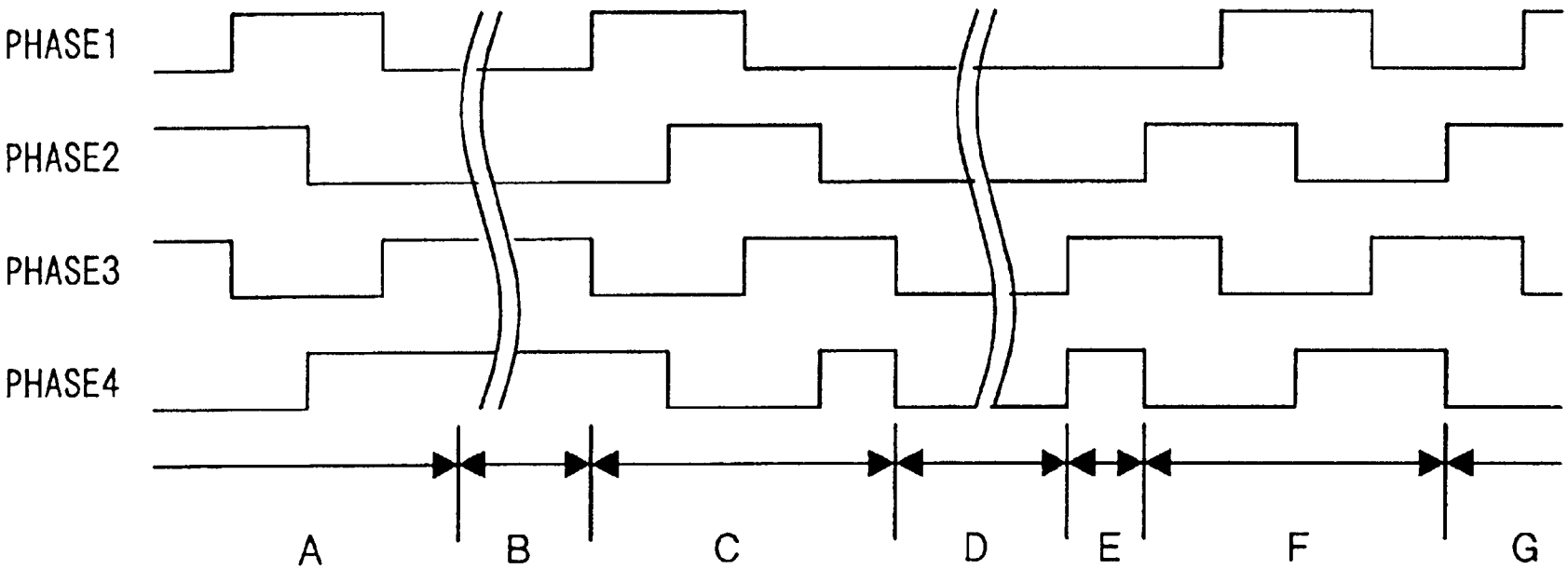
FIG. 2 is a timing chart showing the line printer according to the embodiment of the present invention.
Figure 3:
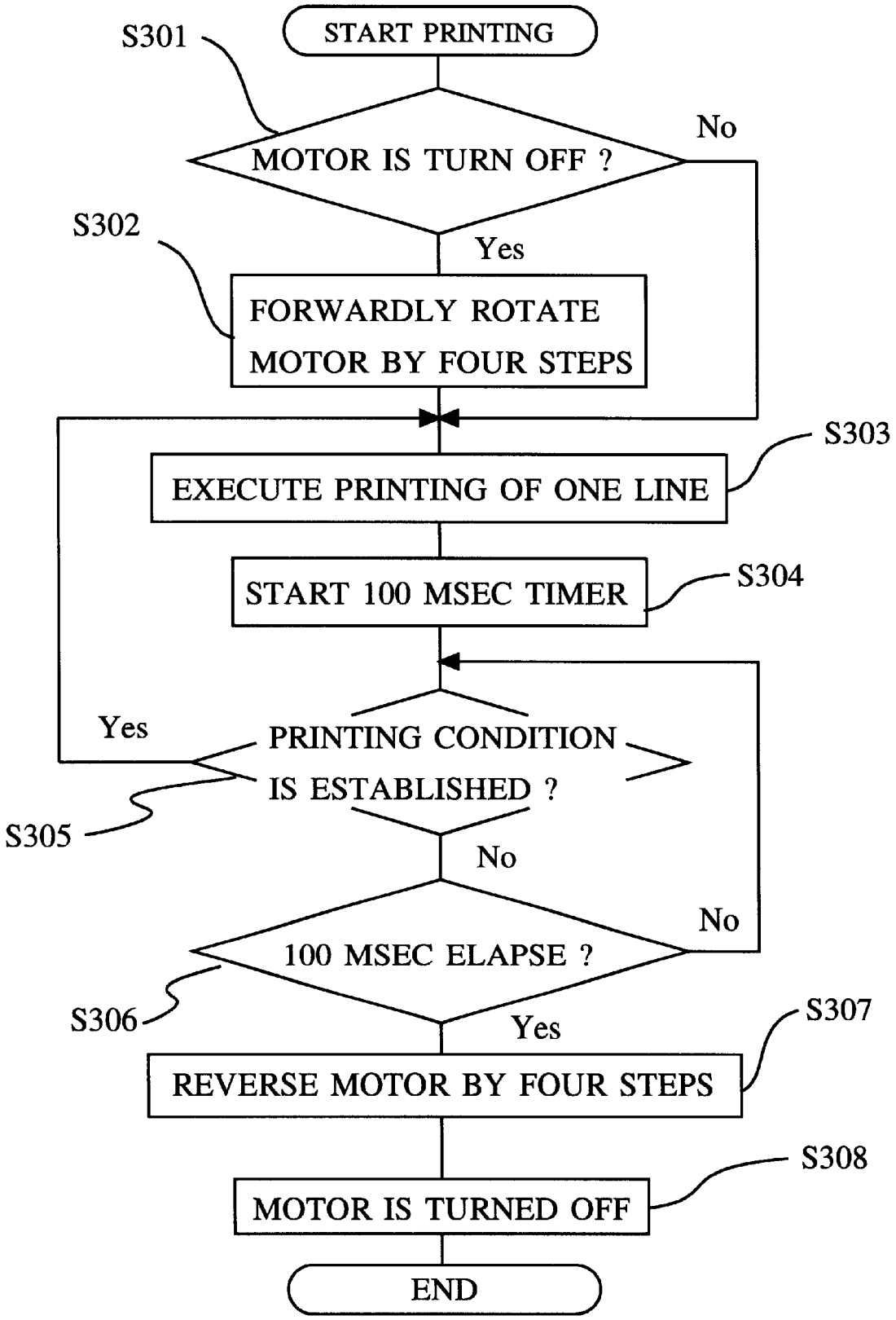
FIG. 3 is a flowchart showing the line printer according to the embodiment of the present invention.
Figure 4:
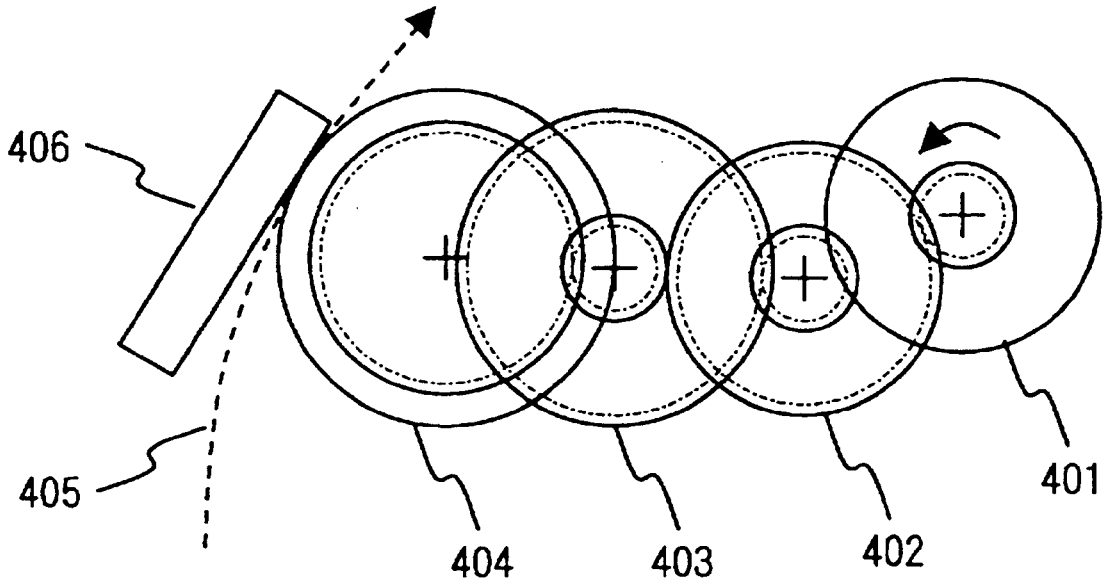
FIG. 4 PRIOR ART
FIG. 4 is a partially side view showing a general line printer.
Figure 5:
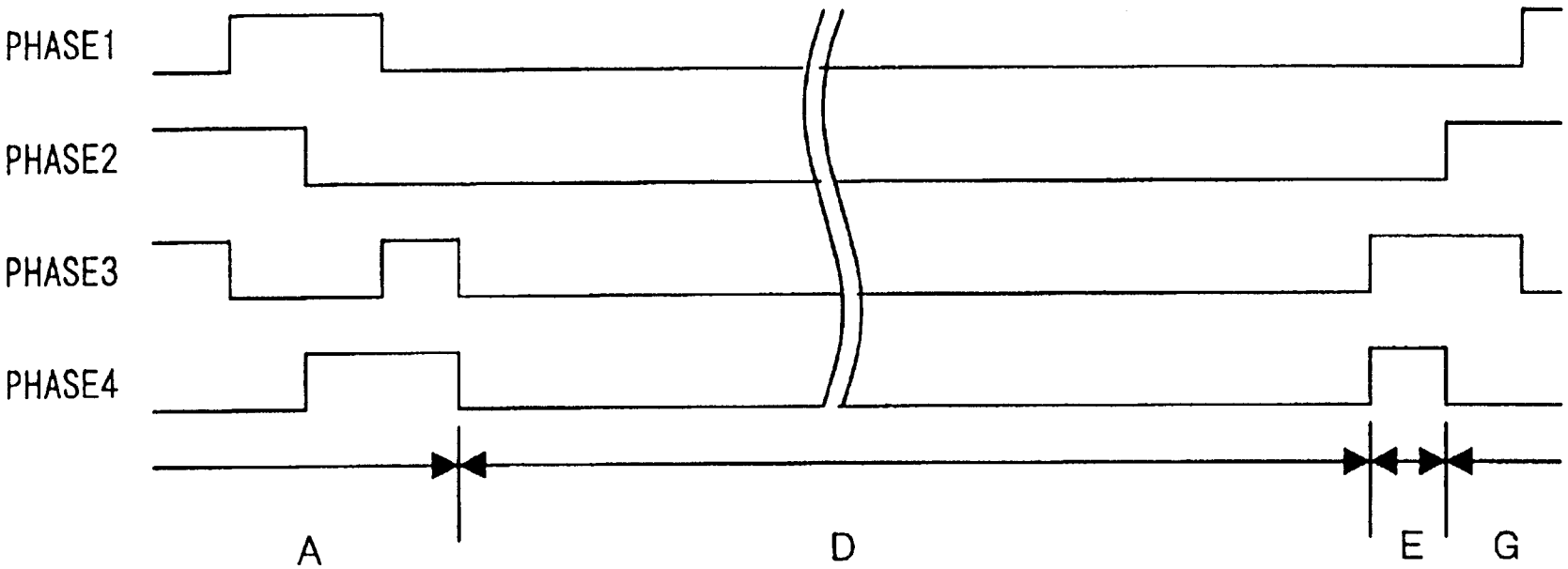
FIG. 5 PRIOR ART
FIG. 5 is a timing chart showing a conventional type line printer.

FIG. 2 is a timing chart showing a driver signal output from the motor control section 106 to the stepping motor 107. FIG. 3 is a flowchart showing processing by the CPU 101.

Referring to FIGS. 1 to 3, the operation of this embodiment will be described below.

First, the CPU 101 judges whether the stepping motor 107 is turned off or not in step S301. The CPU 101 forwardly rotates the stepping motor 107 by four steps in a step S302, if the stepping motor is turned off to execute the printing of one line in step S303. That is, as shown in FIG. 2, after an OFF state in an area D, a driver signal immediately before driving is stopped, is outputted in an area E, and a signal for forwardly rotating the stepping motor 107 by four steps is output in an area F, to start the printing of one line.

In the meantime, in step S301, if the stepping motor 107 is not turned off, processing proceeds to step S303. This indicates a state in an area A shown in FIG. 2, and the printing of one line is successively executed without forwardly rotating the stepping motor 107 by four steps.

Next, a 100 msec timer is started to start a timing operation for 100 msec in a step S304.

Next, whether a printing condition is established or not is judged, and if the printing condition is established such that the print data of the next line is input, processing is returned to step S303 (step S305).

On the other hand, the above-mentioned printing condition is not established, whether 100 msec has elapsed or not is judged in step S306. If 100 msec has not elapsed, processing is returned to step S305. After the stepping motor 107 is reversed by four steps in step S307, if 100 msec has elapsed, the stepping motor 107 is turned off in step S308.

That is, as shown in FIG. 2, the same phase is excited for 100 msec in an area B. If the above-mentioned state is continued for 100 msec, in an area C, the stepping motor is reversed by four steps, and thereafter, the stepping motor 107 is turned off.

By this, series of operations convention of operation can be prevented wherein every time the printing of one line is completed, the reverse and forward rotations of the stepping motor 107 are repeated to thereby lower the printing speed.

As described above, according to this embodiment, it is characterized in that the CPU 101 and the motor driver 106 turn off the stepping motor after reversing the stepping motor 107 by four steps when the stepping motor 107 is turned off to stop printing, and start a printing operation after forwardly rotating the stepping motor 107 by the same four steps as the number of steps reversed when the stepping motor is stopped to start printing. Accordingly, such a line printer can be provided in which misalignment caused by a spring force of a platen roller 404 is prevented, and turbulence when printing is started can be restrained.

Also, while the stepping motor 107 is turned off, driving current is not required to flow, thereby reducing power consumption. Particularly, for a line printer that is driven by a secondary cell, the life of the cell can be extended.

Further, as the stepping motor 107 is driven by four steps immediately before printing, the rotation of the stepping motor 107 can be accelerated for the while, and printing of high quality, which is also substantially free of turbulence at the time when printing is started, can be obtained.

Furthermore, if a printing condition is not established within a predetermined time after the printing of one line is completed, the conventional operation can be prevented where the reverse and forward rotation of the stepping motor 107 are repeated at every printing of one line to lower the printing speed.

In this embodiment, the device is configured such that when the driving of the stepping motor 107 is stopped, the stepping motor is allowed to rotate by four steps. However, it may configured such that the spring force of the platen roller 404 is released to reverse the stepping motor by only the number of steps necessary such that the stepping motor 107 is not rotated. The number of steps may be set to a suitable value in accordance with the spring force of the platen roller 404, the inhibiting torque of the stepping motor 107 and the like. In this case, when the driving of the stepping motor 107 is started, a printing operation has only to be started after the stepping motor is forwardly rotated by the same number of steps as that of reversed steps. The present invention can also be applied to the case of a motor other than the stepping motor.

According to the present invention, turbulence when printing is started can be inhibited at low power consumption.

Particularly, in the line printer that is driven by a cell, the life of the cell can be extended.

What is claimed is:

1. In a line printer having motor control means for rotating a platen roller by driving a motor in a forward direction to feed a print paper by a fixed amount, and in a synchronous manner therewith, and means for effecting printing by driving a print head in accordance with a print signal; wherein the motor control means includes means for performing a stop printing operation to stop printing by turning off the motor after driving the motor in a reverse direction by a predetermined amount, and means for performing a start printing operation to start printing by driving the motor in a forward direction by the predetermined amount before the start of printing.

2. A line printer according to claim 1; wherein the means for performing a stop printing operation of the motor control means turns off the motor after driving the motor in the reverse direction by the predetermined amount when a printing condition is not met within a predetermined time after the printing of one line has been completed.

3. A line printer according to either one of claim 1 or 2; wherein the motor is a stepping motor, the means for performing a stop printing operation turns off the stepping motor after driving the stepping motor in the reverse direction by a predetermined number of steps before the stepping motor is turned off to stop printing, and the means for performing a start printing operation starts a printing operation after driving the stepping motor in the forward direction by the predetermined number of steps.

4. A line printer according to claim 3; wherein the means for performing a start printing operation drives the stepping motor in a forward direction by the predetermined number of steps after outputting a signal having the same phase as a phase output in a preceding stop printing operation immediately before turning off the stepping motor and then starts a printing operation.

5. A line printer according to claim 1; wherein the motor control means drives the motor in the reverse direction by a predetermined amount so that a spring force of the platen roller becomes smaller than an inhibiting torque of the motor.

6. A line printer according to claim 3; wherein the motor control means drives the motor in the reverse direction by the predetermined number of steps so that a spring force of the platen becomes smaller than an inhibiting torque of the motor.

7. A line printer comprising: a motor; a print head; a paper advance mechanism driven by the motor to advance a paper with respect to the print head; a head driver for driving the print head to print on the paper; and a motor control circuit for controlling the motor by performing a print stop operation in which motor is turned off after being driven in a reverse direction by a predetermined amount after a given printing operation has been completed and performing a print start operation in which the motor is driven in a forward direction by the same predetermined amount prior to initiating a printing operation subsequent to the given printing operation.

8. A line printer according to claim 7; wherein the motor control means includes means for performing the print stop operation after determining that no next printing operation is to be performed within a predetermined time period.

9. A line printer according to claim 7; wherein the print head comprises a line print head for printing an entire line of data at a time.

10. A line printer according to claim 9; wherein the motor control means performs the print stop operation after printing a given line and performs the print start operation prior to printing a line immediately succeeding the given line.

11. A line printer according to claim 7; wherein the motor comprises a stepper motor driven in a reverse direction by a predetermined number of steps before being turned off in the print stop operation and driven in the forward direction by the same predetermined number of steps prior to initiating a printing operation in the print start operation.

12. A line printer according to claim 11; wherein the motor control means drives the stepping motor in a forward direction in the print start operation by the predetermined number of steps after outputting a signal having the same phase as a phase output in a preceding print stop operation immediately before turning off the stepping motor and then starts a printing operation.

13. A line printer according to claim 7; wherein the motor control means drives the motor in the reverse direction by a predetermined amount so that a spring force of the paper advance mechanism becomes smaller than an inhibiting torque of the motor.

14. A line printer according to claim 11; wherein the motor control means drives the motor in the reverse direction by the predetermined number of steps so that a spring force of the paper advance mechanism becomes smaller than an inhibiting torque of the motor.

15. A line printer comprising: a motor; a print head; a paper advance mechanism having a platen driven by the motor to advance a paper with respect to the print head; a head driver for driving the print head to print on the paper; and a motor control circuit for controlling the motor by performing a print stop operation in which motor is turned off after being driven in a reverse direction by a predetermined amount after a given printing operation has been completed, the predetermined amount being sufficient so that a spring force of the platen becomes smaller than an inhibiting torques of the motor, and performing a print start operation in which the motor is driven in a forward direction by the same predetermined amount prior to initiating a printing operation subsequent to the given printing operation.

16. A line printer according to claim 15; wherein the motor control circuit includes means for performing the print stop operation after determining that no next printing operation is to be performed within a predetermined time period.

17. A line printer according to claim 15; wherein the print head comprises a line print head for printing an entire line of data at a time.

18. A line printer according to claim 17; wherein the motor control circuit performs the print stop operation after printing a given line and performs the print start operation prior to printing a line immediately succeeding the given line.

19. A line printer according to claim 15; wherein the motor comprises a stepper motor driven in a reverse direction by a predetermined number of steps before being turned off in the print stop operation, the predetermined number of steps being sufficient so that a spring force of the platen becomes smaller than an inhibiting torque of the motor, and is driven in the forward direction by the same predetermined number of steps prior to initiating a printing operation in the in the print start operation.

20. A line printer according to claim 19; wherein the motor control circuit drives the stepping motor in a forward direction in the print start operation by the predetermined number of steps after outputting a signal having the same phase as a phase output in a preceding print stop operation immediately before turning off the stepping motor and then starts a printing operation.

* * * * *